US005214977A

United States Patent [19]

Nagafusa

[11] Patent Number: 5,214,977

[45] Date of Patent: Jun. 1, 1993

[54] REMOTE CONTROL SYSTEM

[75] Inventor: Makoto Nagafusa, Hamamatsu, Japan

[73] Assignee: Sanshin Kogyo Kabushiki Kaisha, Hamamatsu, Japan

[21] Appl. No.: 751,298

[22] Filed: Aug. 28, 1991

[30] Foreign Application Priority Data

Aug. 28, 1990 [JP] Japan ..... 2-227473

[51] Int. Cl.[5] ..... B64H 21/22

[52] U.S. Cl. ..... 74/480 B; 74/501.6; 440/84

[58] Field of Search ..... 74/479, 480 R, 480 B, 74/501.6; 440/58, 62, 87, 84, 86

[56] References Cited

U.S. PATENT DOCUMENTS

| | | | |
|---|---|---|---|
| 2,702,615 | 2/1955 | Morse | 440/87 X |
| 2,869,861 | 1/1959 | Carlson | 268/66 |
| 3,322,994 | 5/1967 | Dever et al. | 313/267 |
| 3,644,816 | 2/1972 | Gilbert | 318/663 |
| 3,651,709 | 3/1972 | Booty et al. | 74/501.6 X |
| 4,004,537 | 1/1977 | Nilsson | 114/144 R |
| 4,020,713 | 5/1977 | Cantley et al. | 74/480 B X |
| 4,079,906 | 3/1978 | Durandeau et al. | 244/194 |
| 4,099,476 | 7/1978 | Inoue et al. | 74/480 B X |
| 4,223,624 | 9/1980 | Iyeta | 114/144 E |
| 4,306,314 | 12/1981 | Griffiths | 445/603 |
| 4,513,235 | 4/1985 | Acklam et al. | 318/685 |
| 4,527,983 | 7/1985 | Booth | 440/7 |
| 4,614,900 | 9/1986 | Young | 318/16 |
| 4,718,869 | 1/1988 | Fisher | 440/1 |
| 4,810,216 | 3/1989 | Kawamura | 440/2 |
| 4,824,408 | 4/1989 | Aertker et al. | 440/6 |
| 4,831,531 | 5/1989 | Adams et al. | 364/424.01 |
| 4,836,809 | 6/1989 | Pelligrino | 440/87 X |
| 4,914,368 | 4/1990 | Orton | 318/663 |
| 4,919,005 | 4/1990 | Schleicher | 74/501.6 |
| 4,920,819 | 5/1990 | Uchida et al. | 74/501.6 X |
| 4,925,416 | 5/1990 | Oishi | 440/86 X |
| 5,029,547 | 7/1991 | Novey | 114/159 |
| 5,058,793 | 10/1991 | Neville et al. | 226/15 |
| 5,072,361 | 12/1991 | Davis et al. | 364/167.01 |
| 5,094,122 | 3/1992 | Okita | 74/480 B |

FOREIGN PATENT DOCUMENTS 61-29068 6/1982 Japan .

*Primary Examiner*—Richard M. Lorence
*Assistant Examiner*—Khoi Q. Ta
*Attorney, Agent, or Firm*—Ernest A. Beutler

[57] ABSTRACT

A remote control system for transmitting control movement to a controlled member, such as a throttle or transmission control lever on a marine propulsion unit, which includes an actuating element that has both manual and electrical modes of operation. In the manual operation mode, a controlled element which is connected to the lever on the propulsion unit is actuated by a lever arm in response to movement of a first operator. In the electrical operation mode, the controlled element is actuated by a motor which is operated in response to electrical signals transmitted to the motor through a control unit from a position detector of the actuating element in response to movement of the first operator and from a position detector associated with the controlled element. A second remote operator is also provided for transmitting movement to the controlled element and lever on the propulsion unit. When this second operator is used, an electrical signal is transmitted from a position detector in response to movement of the second operator to the control unit which also receives a feedback signal from the position detector associated with the controlled element to control operation of the motor. A switch mechanism is provided for switching the actuating element between the first and second modes of operation. The switch mechanism preferably comprises a stopper pin that is selectively engageable with the lever arm for setting the actuating element in the first mode of operation and with a motor driven gear for setting the actuating element in the second mode of operation.

7 Claims, 6 Drawing Sheets

REMOTE CONTROL SYSTEM

BACKGROUND OF THE INVENTION

This invention relates to a remote control system, and more particularly to an improved remote control system of the type which includes a plurality of separate operators, at least one of which may be selectively operated for either electrically or mechanically actuating a controlled member and at least one of which may be selectively operated for electrically actuating the controlled member.

There are provided a number of types of remote control systems which have been used in connection with a marine propulsion unit wherein two separately positioned operators may be employed to operate the same controlled member on the propulsion unit. For example, it is common practice on certain watercraft to have throttle/shift control operators both at the bridge and in the cabin of the watercraft.

One type of fully mechanical remote control system has been proposed which utilizes wire cables to transmit the movement of one or the other of a pair of remote control operators to a controlled member on the propulsion unit using a switchover device. An example of such an arrangement is set forth in Japanese utility model publication SHO61-29068. While this type of remote control system has certain advantages, it also has certain disadvantages associated with it. For example, the wire cables connecting the operators with the switchover device and connecting the switchover device with the controlled member on the propulsion unit increases the operating load of the system. Also, this type of system may require relatively long cables, depending on the location of the operators and the size of the watercraft. The longer the cables, the more likely they are to bend, causing the remote control system to malfunction. Changing control smoothly from one location to the other has also been difficult with these wholly mechanically operated systems because it has typically been difficult for someone at one remote location in the watercraft to know the control state of the operator at the other location.

While an all electrical remote control system may decrease the system's operational load and may also decrease the system's tendency to malfunction as a result of cable bending, such a system is disadvantageous in that no means are provided on the watercraft for manually operating the controlled member should that become necessary to maintain control of the watercraft in the event of an electrical component or power failure.

One type of system has been provided to eliminate or reduce these disadvantages which employs two separate remotely positioned operators, one manually connected to a manual actuating mechanism and one electrically connected to an electric actuating mechanism, switchable from one to the other for selectively actuating the same controlled member. See Japanese Patent Application HEI2-50492. Although this system provides certain advantages, it requires, in addition to operation of the propulsion unit itself, a relatively time consuming and complicated switching operation from electric to manual control and vice versa, which makes the over all operation of the propulsion unit more time consuming.

It is therefore a principal object of this invention to provide an improved remote control system which eliminates or reduces the above disadvantages and inconveniences.

It is a further object of this invention to provide an improved remote control system which employs a plurality of separate remotely positioned operators, at least one of which may be selectively connected either mechanically or electrically to a controlled element for selectively actuating a controlled member, and at least one of which is electrically connected to the controlled element for selectively actuating that same controlled member.

SUMMARY OF THE INVENTION

This invention is adapted to be embodied in a remote control system for transmitting control movement to a controlled element. The remote control system comprises an actuating element and a control unit. The system further includes a first remote control unit having a first operator mechanically connected to the actuating element which has a first mode of operation for mechanically transmitting movement to the controlled element upon movement of the first operator and a second mode of operation for transmitting an electrical signal to the control unit for electrically transmitting movement to the controlled element upon movement of the first operator. There is also provided a second remote control unit having a second operator electrically connected to the control unit for selectively causing an electrical signal to be transmitted to the control unit for selectively transmitting movement to the controlled element upon movement of the second operator, and means for switching between the first and second modes of operation of the actuating element.

DETAILED DESCRIPTION OF THE PREFERRED EMBODIMENT OF THE INVENTION

Figure 1:
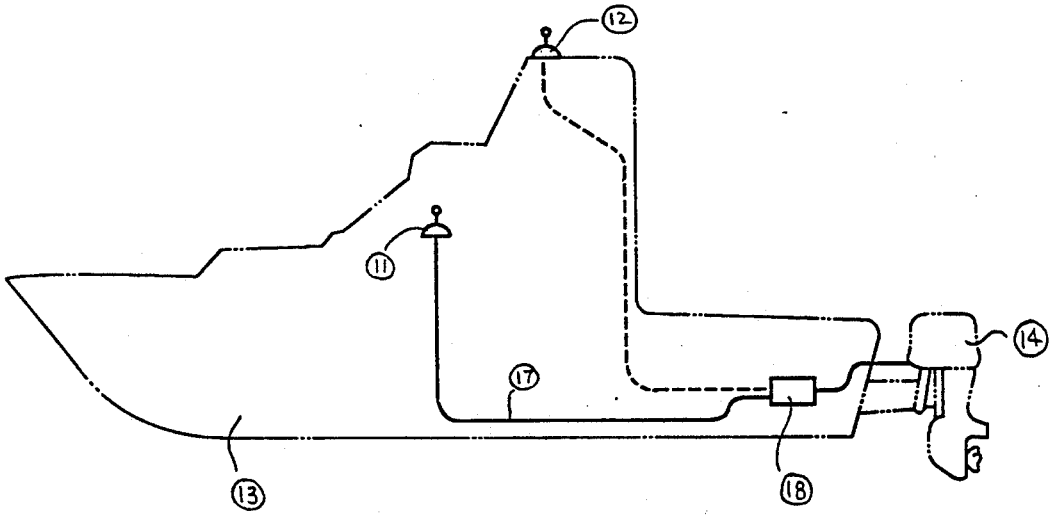
FIG. 1 is a partially perspective and partially schematic view of the remote control system for a marine propulsion unit and associated watercraft constructed in accordance with the invention.

Referring first to FIG. 1, a remote control system for operating a marine propulsion unit from either of two remote locations is depicted. A manual/electromotive remote control unit, identified generally by the reference numeral 11, is positioned at one of these locations, and an electromotive remote control unit, indicated generally by the reference numeral 12, is positioned at the other location. The remote control unit 11 is preferably located in the cabin of an associated watercraft 13, and the electromotive remote control unit 12 is preferably located on the bridge, although these locations can be reversed or other locations can be used. The remote control units 11 and 12 are provided for controlling a throttle and/or transmission control lever of a marine propulsion unit, identified generally by the reference numeral 14.

It should be noted that in the illustrated embodiments, the propulsion unit 14 comprises an outboard motor; however, it may alternatively comprise the outboard drive portion of an inboard/outboard drive unit. The propulsion unit 14 includes a powering internal combustion engine and a throttle control lever that is adapted to control the speed of the engine in a known manner. The transmission control lever is designed to operate a conventional forward, neutral, reverse transmission of the type normally employed with such propulsion units.

Figure 2:
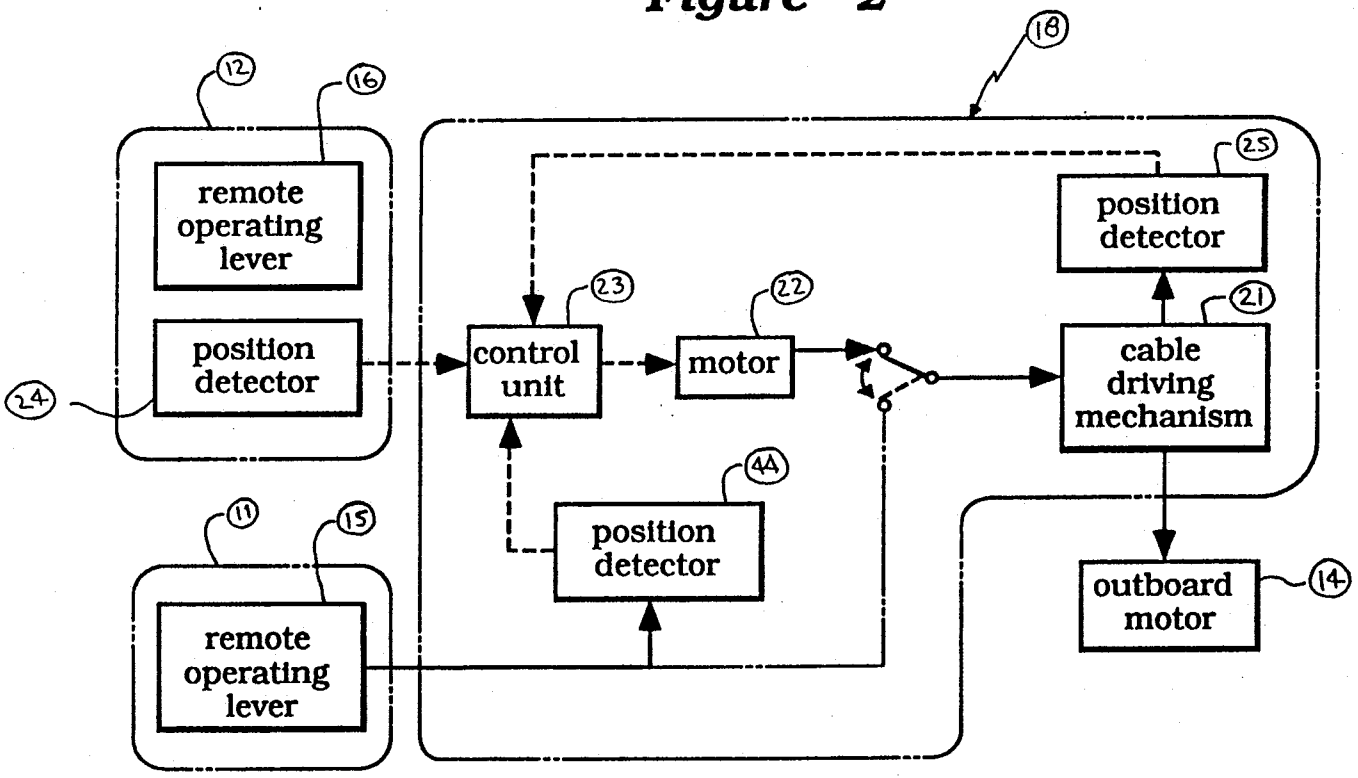
FIG. 2 is a block diagram illustrating the arrangement and operation of the remote control system of FIG. 1.

Referring now to FIG. 2, in addition to FIG. 1, the remote control units 11 and 12 are comprised of control operators 15 and 16, respectively, for controlling either or both the throttling and transmission of the engine. If used to control throttle operation, each of the operators 15 and 16 will be movable between an idle position and a position corresponding to a fully open throttle. If used to control transmission operation, each of the operators 15 and 16 will be movable between a neutral position and forward and reverse drive positions. If the operators 15 and 16 are used to control both throttle and transmission operation, the neutral position will also correspond to the idle throttle position, while the forward and reverse drive positions will correspond to various throttle opening positions, ranging from partially to fully opened.

A bowden wire cable 17 extends between the operator 15 and an actuator unit, identified generally by the reference numeral 18. When switched for mechanical actuation, the actuator unit 18 actuates the throttle or transmission control lever on the propulsion unit 14 through a lever arm 19 (see FIG. 3) and a controlled element 21 in response to movement of operator 15. When the actuator unit 18 is switched for electrical actuation, the throttle or transmission control lever is actuated by an electric motor 22 and the controlled element 21 in response to movement of operator 15. The switching of the actuator unit 18 between mechanical and electrical actuation is accomplished as hereinafter described.

Whereas the operator 15 is mechanically linked to the lever arm 19 of the actuator unit 18 through cable 17, operator 16 is electrically connected to a control unit 23 through a control position detector 24 which is positioned in proximity to the operator 16 and which forms a part of the electromotive remote control unit 12. When operator 16 is selected, this detector 24 detects the position of the operator 16 as it is moved and transmits an electrical signal indicative of this detected movement or position to the control unit 23. Another position detector 25, associated with the controlled element 21, detects the movement of the controlled element 21 or cable driving mechanism and outputs an electrical feedback signal to the control unit 23 indicative of the position of the controlled element 21, and hence the position of the throttle and/or transmission control lever.

The control unit 23 which includes a comparator circuit compares the signals received from detectors 24 and 25 and outputs a difference signal to the motor 22 for controlling its operation to null the difference signal. Upon receipt of the difference signal, the motor 22 actuates the controlled element 21 which, in turn, actuates the throttle or transmission control lever in a manner to be described.

Figure 3:
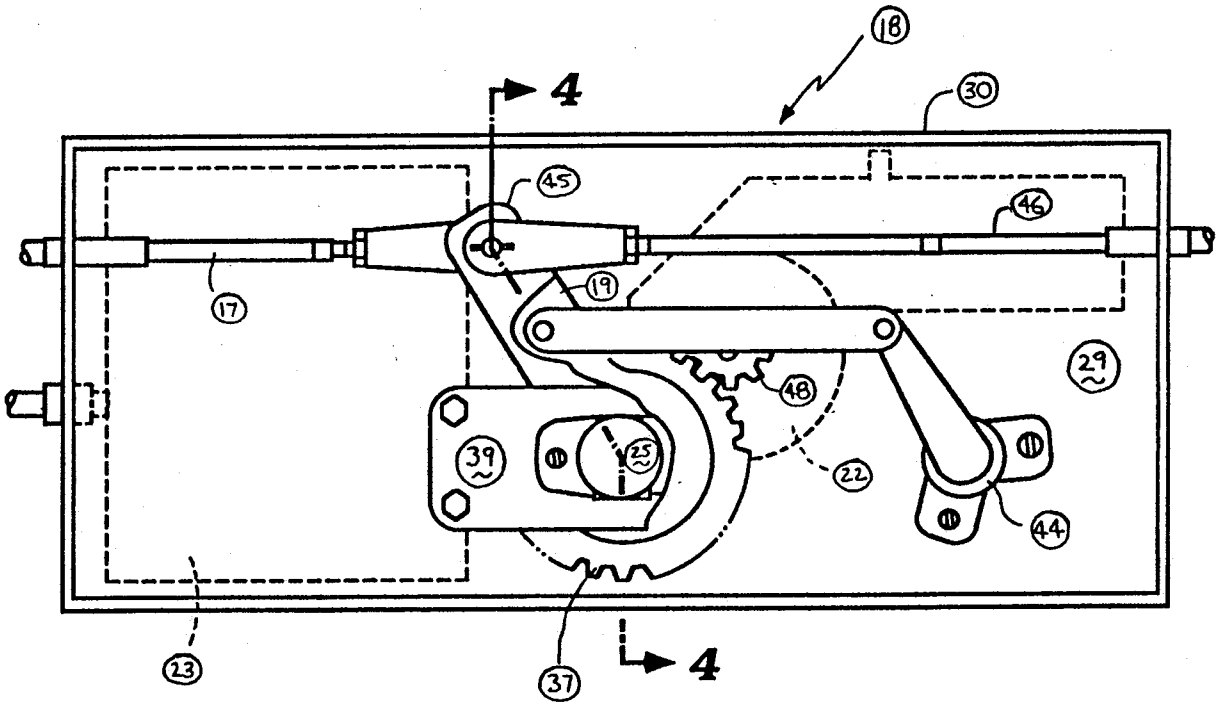
FIG. 3 is a perspective view of the actuator unit.
Figure 4:
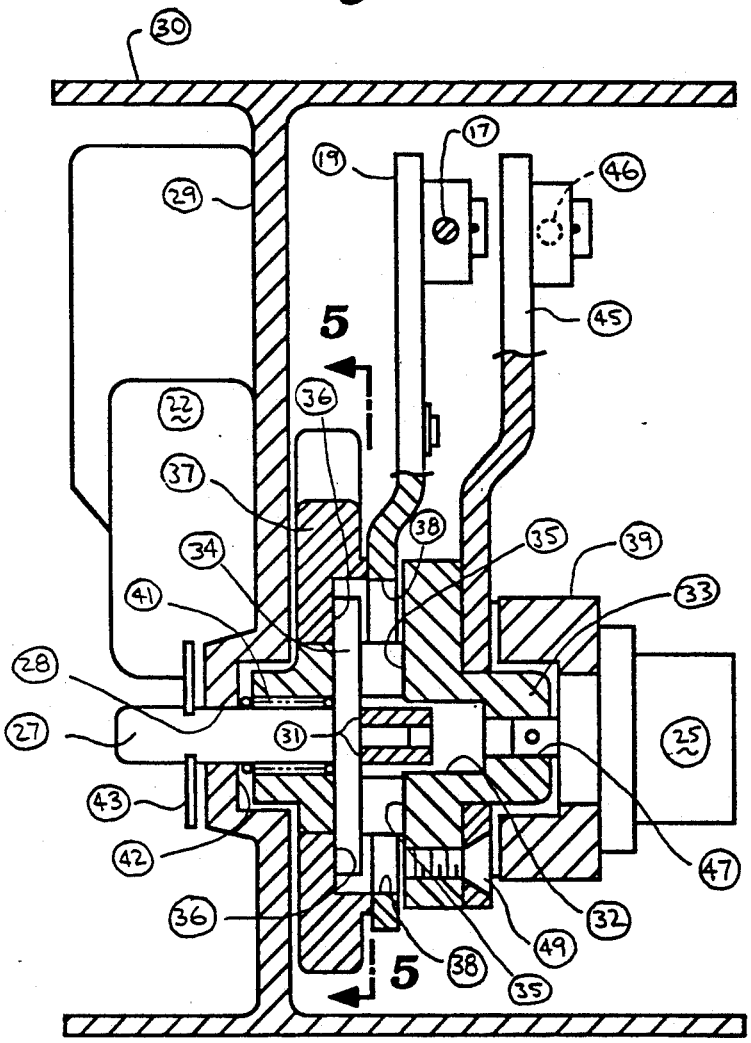
FIG. 4 is an enlarged cross-sectional view taken along line 4—4 in FIG. 3 showing the stopper plate in its engaged position.
Figure 5:
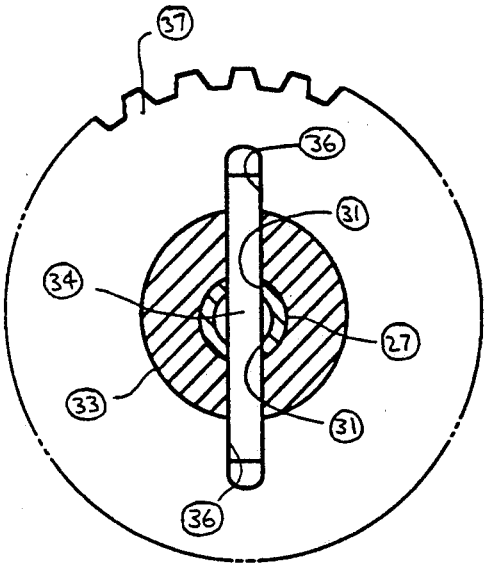
FIG. 5 is a cross-sectional view taken along line 5—5 in FIG. 4.

Referring now to FIGS. 3, 4 and 5 in addition to FIG. 2, the arrangement and operation of the actuator unit 18 can be seen. When the operator 15 is used for control, the actuator unit 18 may be switched for either mechanical or electrical actuation of the controlled element 21. To this end, there is provided switching means that is comprised of a pin holder 27 which is slidably received within an aperture 28 formed in an interior wall portion 29 of the main housing 30 which encases the actuator unit 18. The pin holder 27 is also slidably received within a horizontal bore 32 that is formed in an axis piece 33 of the actuator unit 18. A stopper pin 34 is affixed within a vertical hole 31 opened on the pin holder 27 and is movable within a slot 35 formed in the axis piece 33 between a first position wherein the pin 34 is engaged with a stopper groove 36 of a gear 37 driven by the motor 22, as shown in FIG. 4, and a second position wherein the pin 34 is engaged with a stopper groove 38 of the lever arm 19. The driven gear 37 and lever arm 19 are mounted for pivotal movement about the axis piece 33 and, in accordance with the invention, may pivot with or independently of the axis piece 33 which has one end positioned in a cavity formed in the interior wall portion 29 and the other end fitted in a cavity formed by housing piece 39. A coil compression spring 41 encircles the pin holder 27 and is positioned within the horizontal bore 32. One end of the spring 41 bears against an inner wall 42 of the cavity formed in wall 29 and the other end engages the stopper pin 34 to urge the pin 34 into engagement with the stopper groove 38 of the lever arm 19. However, a stopper plate 43 is provided which, when inserted into the pin holder 27, as shown in FIG. 4, maintains the stopper pin 34 in contact with the stopper groove 36 of the driven gear 37 so that the actuating element which comprises the lever 19 and control position detector 44 is switched for electrical operation.

When the operator 15 is selected under this electrical mode of operation, movement of the operator 15 effects a push-pull movement on bowden wire cable 17 which, in turn, transmits movement to the lever arm 19. In this case, lever arm 19 rotates independently of the axis piece 33. However, the control position detector 44, which is connected to the lever 19 by means of a link, detects the position or movement of the lever 19 and hence, the position of the operator 15 and transmits an electrical signal indicative of this detected position to the control unit 23. Upon movement of the operator 15, the control unit 23 also receives an electrical signal from the detector 25 which is mounted against housing piece 39 and which has the inner end of its axis fitted in a smaller diameter bore 47 formed horizontally in the axis piece 33 coaxially with the bore 32. The signal produced by detector 25 is indicative of the detected position of a second lever arm 45 and a cable 46 which connects the lever arm 45 with the throttle or transmission control lever on the marine propulsion unit 14. By virtue of this connection, the detected position of the lever 45, which forms a part of the controlled element 21, and cable 46 correspond to the detected position of the throttle or transmission control lever.

In operation, the comparator circuit of the control unit 23 compares the signals received from the detectors 25 and 44 and outputs a difference signal to the motor 22 for controlling its operation to null the difference signal. The motor 22 includes a driving gear 48 that has teeth enmeshed with the teeth of driven gear 36 so that when the motor 22 is operated upon receipt of the difference signal the gear 37 is driven. In the electric operation mode, gear 37 is engaged for rotation with the axis piece 33 as a result of the stopper pin 34 being seated within the stopper groove 36. Thus, when gear 37 is rotated, the pin holder 27 and axis piece 33 are also rotated to cause pivotal movement of lever arm 45 which is affixed for rotation with the axis piece 33 by a screw 49. This effects a push-pull movement on bowden wire cable 46 so as to effect movement of the transmission or throttle control lever until the position of the lever corresponds with the position of the operator 15.

Figure 6:
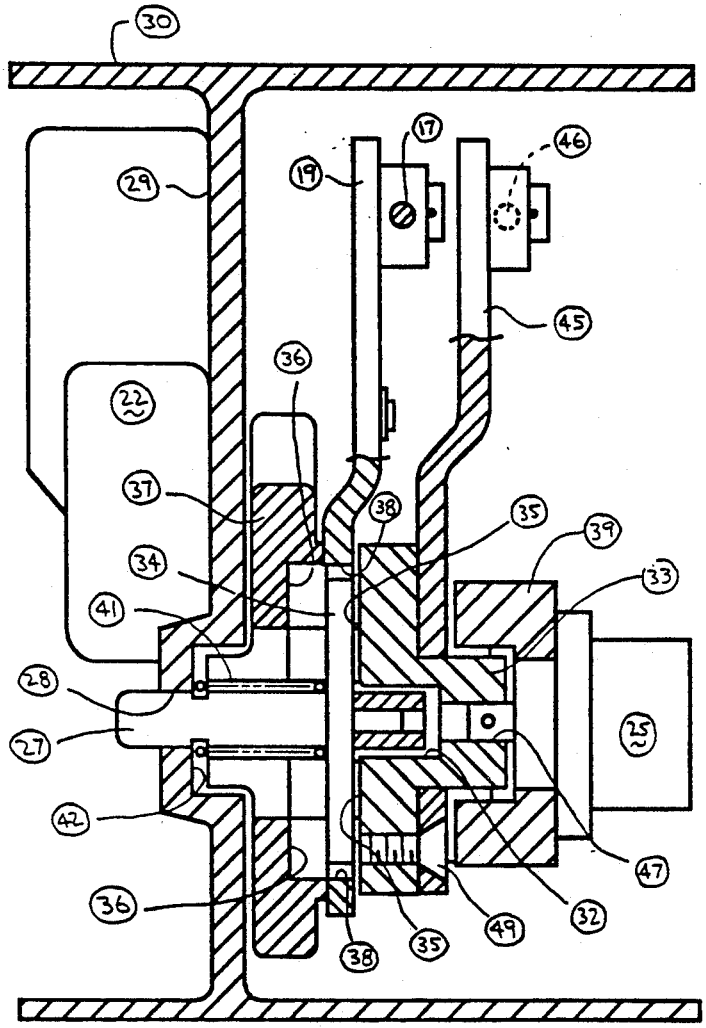
FIG. 6 is an enlarged cross-sectional view, similar to the view of FIG. 4, showing the stopper plate in its released position.

As previously noted, the actuator unit 18 can be switched for manual actuation as well. To do this, the stopper plate 43 is removed, as shown in FIG. 6, so that the spring 41 urges the stopper pin 34 into engagement with the stopper groove 38 of lever 19 to place the actuating element in the manual operation mode. Now, when the operator 15 is moved, operation of the motor 22 cannot actuate the lever arm 45 since the driven gear 37 is not connected for rotation with the axis piece 33. In this case, it is the lever arm 19 which is fixed for rotation with the axis piece 33 by virtue of the stopper pin 34 being seated in stopper groove 38. Thus, movement of the operator 15 is transmitted mechanically to the lever 45 through the lever arm 19 and axis piece 33. That is, when the stopper pin 34 is engaged with the stopper groove 38, rotation of the lever arm 19 causes rotation of the axis piece 33 and lever arm 45 which, as previously noted, is affixed to the axis piece 33 by the screw 49. Movement of the lever arm 45 then actuates the throttle or transmission control lever through the cable 46.

Operator 16 is adapted for electrical operation and therfore is operated when the stopper pin 34 in engaged with the stopper groove 36 of the driven gear 37. When the operator 16 is moved the signals transmitted by the detectors 24 and 25 to the control unit 23 are compared and a difference signal is outputted by the control unit 23 to the motor 22 to operate it so as to null the difference signal. Upon receipt of the difference signal, the motor 22 and its driving gear 48 impart movement on gear 37 to actuate the throttle or transmission control lever through lever arm 45 and cable 46 as previously described.

From the foregoing description it should be readily apparent that the described remote control system is extremely effective in controlling a controlled member such as a throttle or transmission control lever from a plurality of remote locations either electrically or mechanically. The system is adapted for electrical control at one remote location and is selectively adapted for either electrical or mechanical control from another remote location. Although embodiments of the invention have been illustrated and described, various changes and modifications may be made without departing from the spirit and scope of the invention, as defined by the appended claims.

I claim:

1. A remote control system for transmitting control movement to a controlled element comprising an actuating element, a main control unit, a first remote control unit having a first operator mechanically connected to said actuating element, said actuating element having a first mode of operation for mechanically transmitting movement to said controlled element upon movement of said first operator and having a second mode of operation for transmitting an electrical signal to said main control unit for electrically transmitting movement to said controlled element upon movement of said first operator, a second remote control unit having a second operator electrically connected to said main control unit for selectively causing an electrical signal to be transmitted to said main control unit for selectively transmitting movement to said controlled element upon movement of said second operator, and means for switching between the first and second modes of operation of said actuating element, wherein said actuating element comprises a lever arm and a position detector mechanically connected to said lever arm and electrically connected to said main control unit.

2. A remote control system for transmitting control movement to a controlled element comprising an actuating element, a main control unit, a first remote control unit having a first operator mechanically connected to said actuating element, said actuating element having a first mode of operation for mechanically transmitting movement to said controlled element upon movement of said first operator and having a second mode of operation for transmitting an electrical signal to said main control unit for electrically transmitting movement to said controlled element upon movement of said first operator, a second remote control unit having a second operator electrically connected to said main control unit for selectively causing an electrical signal to be transmitted to said main control unit for selectively transmitting movement to said controlled element upon movement of said second operator, and means for switching between the first and second modes of operation of said actuating element, wherein said switching means comprises a pin holder.

3. A remote control system as recited in claim 2, wherein said switching means further comprises a stopper pin.

4. A remote control system for transmitting control movement to a controlled element comprising an actuating element, a main control unit, a first remote control unit having a first operator mechanically connected to said actuating element, said actuating element having a first mode of operation for mechanically transmitting movement to said controlled element upon movement of said first operator and having a second mode of operation for transmitting an electrical signal to said main control unit for electrically transmitting movement to said controlled element upon movement of said first operator, a second remote control unit having a second operator electrically connected to said main control unit for selectively causing an electrical signal to be transmitted to said main control unit for selectively transmitting movement to said controlled element upon movement of said second operator, and means for switching between the first and second modes of operation of said actuating element, wherein said switching means comprises a stopper pin and said remote control system further comprises a motor, a lever having a stopper groove, a gear driven by said motor and having a stopper groove wherein said stopper pin is selectively engageable with said lever stopper groove for setting said actuating element in the first mode of operation and with said gear stopper groove for setting said actuating element in the second mode of operation.

5. A remote control system as recited in claim 1, wherein said switching means comprises a pin holder.

6. A remote control system as recited in claim 5, wherein said switching means further comprises a stopper pin.

7. A remote control system as recited in claim 1, wherein said switching means comprises a stopper pin and said remote control system further comprises a motor, a lever having a stopper groove, a gear driven by said motor and having a stopper groove wherein said stopper pin is selectively engageable with said lever stopper groove for setting said actuating element in the first mode of operation and with said gear stopper groove for setting said actuating element in the second mode of operation.

* * * * *